US005593610A

United States Patent [19]

Minerich et al.

[11] Patent Number: 5,593,610

[45] Date of Patent: Jan. 14, 1997

[54] CONTAINER FOR ACTIVE MICROWAVE HEATING

[75] Inventors: Phillip L. Minerich, Austin, Minn.; Bryan C. Hewitt, Kingston, Canada; Cindy M. Lacroix, Kingston, Canada; Melville D. Ball, Kingston, Canada

[73] Assignee: Hormel Foods Corporation, Austin, Minn.

[21] Appl. No.: 511,383

[22] Filed: Aug. 4, 1995

[51] Int. Cl.[6] ..... H05B 6/80

[52] U.S. Cl. ..... 219/728; 219/729; 219/730; 219/734; 426/234; 99/DIG. 14

[58] Field of Search ..... 219/728, 729, 219/730, 734, 735, 759; 99/DIG. 14; 426/107, 234, 241, 243

[56] References Cited

U.S. PATENT DOCUMENTS

| | | |
|---|---|---|
| 3,240,610 | 3/1966 | Cease . |
| 3,777,099 | 12/1973 | Levinson . |
| 3,835,280 | 9/1974 | Gades et al. . |
| 3,845,266 | 10/1974 | Derby . |
| 3,985,991 | 10/1976 | Levinson . |
| 4,081,646 | 3/1978 | Goltsos . |
| 4,190,757 | 2/1980 | Turpin et al. . |
| 4,223,194 | 9/1980 | Fitzmayer . |
| 4,230,924 | 10/1980 | Brastad et al. . |
| 4,320,274 | 3/1982 | Dehn . |
| 4,345,133 | 8/1982 | Cherney et al. . |
| 4,351,997 | 9/1982 | Mattisson et al. . |
| 4,369,346 | 1/1983 | Hart et al. . |
| 4,398,994 | 8/1983 | Beckett . |
| 4,481,392 | 11/1984 | Nibbe et al. . |
| 4,495,392 | 1/1985 | Derby ..... 219/728 |
| 4,501,946 | 2/1985 | Nibbe et al. . |
| 4,517,045 | 4/1985 | Beckett . |
| 4,552,614 | 11/1985 | Beckett . |
| 4,594,492 | 6/1986 | Maroszek . |
| 4,610,755 | 9/1986 | Beckett . |
| 4,620,169 | 10/1986 | Blickstein . |
| 4,656,325 | 4/1987 | Keefer . |
| 4,675,697 | 6/1987 | Sasaki et al. . |
| 4,676,428 | 6/1987 | McClure . |
| 4,685,997 | 8/1987 | Beckett . |
| 4,689,458 | 8/1987 | Levendusky et al. . |
| 4,703,148 | 10/1987 | Mikulski et al. . |
| 4,709,129 | 11/1987 | Osepchuk . |
| 4,777,053 | 10/1988 | Tobelmann . |
| 4,786,773 | 11/1988 | Keefer . |
| 4,814,568 | 3/1989 | Keefer . |
| 4,831,224 | 5/1989 | Keefer . |
| 4,851,631 | 7/1989 | Wendt . |
| 4,859,822 | 8/1989 | Ragusa et al. . |
| 4,866,232 | 9/1989 | Stone . |
| 4,866,234 | 9/1989 | Keefer . |

(List continued on next page.)

FOREIGN PATENT DOCUMENTS

| | | |
|---|---|---|
| 1082655 | 7/1980 | Canada . |
| 1202088 | 3/1986 | Canada . |
| 1235363 | 4/1988 | Canada . |
| 205304 | 12/1986 | European Pat. Off. . |
| 326811 | 8/1989 | European Pat. Off. . |
| 365247 | 4/1990 | European Pat. Off. . |
| 371739 | 6/1990 | European Pat. Off. . |
| WO91/11893 | 8/1991 | WIPO . |
| WO92/19511 | 11/1992 | WIPO . |
| WO92/19515 | 11/1992 | WIPO . |

*Primary Examiner*—Philip H. Leung
*Attorney, Agent, or Firm*—Calfee, Halter & Griswold

[57] ABSTRACT

An microwave container with synergistic active elements provides more uniform heating than prior art containers, and is more tolerant of variations in food product, load and heating conditions. The active elements (which are conductive and microwave opaque) include an annular ring in the base of the container, a band extending from the base of the side walls up the walls to a level approximately even with the anticipated fill level in the container, a lip extending from the bottom of the side walls onto the base, and at least one, preferably three cooperative active elements in the lid of the container. These containers can be used for thawing and cooking frozen, uncooked meats and other foods, with which prior art containers produced unsatisfactory results.

25 Claims, 5 Drawing Sheets

U.S. PATENT DOCUMENTS

| | | | |
|---|---|---|---|
| 4,874,618 | 10/1989 | Seaborne . | |
| 4,874,917 | 10/1989 | Weimer . | |
| 4,876,423 | 10/1989 | Tighe . | |
| 4,876,427 | 10/1989 | Mode . | |
| 4,877,932 | 10/1989 | Bernstein . | |
| 4,877,933 | 10/1989 | Yangas . | |
| 4,878,765 | 11/1989 | Watkins et al. . | |
| 4,882,463 | 11/1989 | Kyougoku . | |
| 4,883,935 | 11/1989 | Fairchild et al. . | |
| 4,883,936 | 11/1989 | Maynard et al. . | |
| 4,888,459 | 12/1989 | Keefer . | |
| 4,890,439 | 1/1990 | Smart et al. . | |
| 4,892,213 | 1/1990 | Mason, Jr. . | |
| 4,894,247 | 1/1990 | Fong . | |
| 4,894,503 | 1/1990 | Wendt . | |
| 4,896,009 | 1/1990 | Pawlowski . | |
| 4,900,762 | 1/1990 | Broemmelsiek et al. . | |
| 4,901,911 | 2/1990 | Drexhage . | |
| 4,904,836 | 2/1990 | Turpin et al. . | |
| 4,911,938 | 3/1990 | Fisher et al. . | |
| 4,915,780 | 4/1990 | Beckett . | |
| 4,916,280 | 4/1990 | Havette . | |
| 4,917,748 | 4/1990 | Harrison . | |
| 4,924,048 | 5/1990 | Bunce et al. . | |
| 4,924,049 | 5/1990 | Dexter, Jr. . | |
| 4,926,020 | 5/1990 | Atwell et al. . | |
| 4,927,991 | 5/1990 | Wendt et al. . | |
| 4,933,193 | 6/1990 | Fisher . | |
| 4,933,525 | 6/1990 | St. Phillips . | |
| 4,933,526 | 6/1990 | Fisher et al. . | |
| 4,933,528 | 6/1990 | Barr . | |
| 4,935,377 | 6/1990 | Strifler et al. . | |
| 4,936,935 | 6/1990 | Beckett . | |
| 4,937,410 | 6/1990 | Anderson . | |
| 4,938,990 | 7/1990 | Beckett . | |
| 4,939,332 | 7/1990 | Hahn . | |
| 4,940,158 | 7/1990 | Farell et al. . | |
| 4,940,168 | 7/1990 | Shadwell et al. . | |
| 4,943,439 | 7/1990 | Andreas et al. . | |
| 4,948,932 | 8/1990 | Clough . | |
| 4,950,524 | 8/1990 | Hacker . | |
| 4,950,859 | 8/1990 | Anderson . | |
| 4,954,356 | 9/1990 | Kappes . | |
| 4,960,598 | 10/1990 | Swiontek . | |
| 4,962,000 | 10/1990 | Emslander et al. . | |
| 4,962,293 | 10/1990 | Lackey . | |
| 4,965,424 | 10/1990 | Bagley . | |
| 4,970,360 | 11/1990 | Pesheck et al. . | |
| 4,972,058 | 11/1990 | Benson . | |
| 4,972,059 | 11/1990 | Wendt et al. . | |
| 4,990,735 | 2/1991 | Lorenson et al. . | |
| 4,992,638 | 2/1991 | Hewitt et al. . | |
| 5,071,710 | 12/1991 | Smits et al. . | |
| 5,079,397 | 1/1992 | Keefer . | |
| 5,117,078 | 5/1992 | Beckett . | |
| 5,126,518 | 6/1992 | Beckett . | |
| 5,126,520 | 6/1992 | Nottingham et al. | 219/729 |
| 5,213,902 | 5/1993 | Beckett . | |
| 5,310,980 | 5/1994 | Beckett . | |
| 5,391,430 | 2/1995 | Fabish et al. . | |
| 5,468,939 | 11/1995 | MacLean, IV | 219/728 |

CONTAINER FOR ACTIVE MICROWAVE HEATING

BACKGROUND OF THE INVENTION

This invention relates to a container for active microwave heating of food products. More particularly, this invention relates to an improved active container system which, surprisingly, is capable of heating or cooking a variety of food products of varying sizes and types. In addition to the pre-cooked and frozen foods that are commonly thawed and reheated in conventional microwave packages, the containers of this invention can be used to thaw and cook frozen foods such as meat. All of these products can be thoroughly and evenly cooked or heated in an energy efficient way, with no significant overcooked, dried or scorched regions.

Microwave heating offers significant advantages in thawing and reheating of food products. Most important, for the ordinary consumer, is the reduced time required to heat many frozen foods. There are substantial drawbacks, however. With conventional packaging, microwave heating is generally uneven, leaving certain areas such as the center of the food product inadequately heated, while regions of the food near the edge of the container tend to be overheated, dried and/or burned.

A variety of designs and approaches have been used to address this problem. Some designs place microwave reflective materials, such as metallic foils, in parts of the container to "shield" parts of the food that tend to be overdone. This reduces the amount of energy reaching these portions of the food, however, which increases cooking times and decreases energy efficiency.

Examples of shielded packages are disclosed in U.S. Pat. Nos. 4,351,997 to Mattison, 3,240,610 to Cease, 3,408,164 to Goltsos and 4,268,738 to Flautt et al, Canadian patent 1,202,088 to Kwis et al. and EPO application 92105572.9 to Saunier. While they reduce overheating of the food around the edges of the package, packages such as these have had limited commercial application. The added cost of the containers has usually overshadowed the potential benefits.

A more recent approach utilizes materials in, or parts of, the package to modify microwave fields therein. This type of packaging, disclosed in U.S. Pat. Nos. 4,656,325 to Keefer, 4,814,568 to Keefer, 4,831,224 to Keefer, 4,866,234 to Keefer, 4,888,459 to Keefer, 4,992,638 to Hewitt et al and 4,990,735 to Lorenson et al, is sometimes referred to as "active" microwave packaging. "Active microwave packaging" has been defined as packaging "that changes the electric (or magnetic) field configuration and thus the heating pattern of the product contained within. Active packaging also includes susceptors or heater boards that are included in a package to brown or crisp a product." Buffler, Charles R., *Microwave Cooking and Processing, Engineering Fundamentals for the Food Scientist*, Van Nostrand Reinhold, New York, 1993.

Active packages that modify the electrical field make more efficient use of the microwave energy impinging upon them, and provide more even heating of food or other materials in the container. Thus, they make microwave heating practical for many products that could not be heated satisfactorily in other prior art packages. Previous designs of this type, however, have not provided enough control to deal with particularly difficult products, such as relatively large (more than about 300 grams) of uncooked, frozen meat products.

SUMMARY OF THE INVENTION

It is an object of this invention to provide an improved active microwave container that modifies the microwave field in the container to more uniformly distribute the energy for defrosting, heating and cooking of foods.

Another object of the invention is to provide a container-that produces satisfactory results with a wider variety of food products than currently available containers. Yet another object is to provide a container in which frozen, uncooked meats and other foods can retain good quality when thawed and cooked in a microwave oven.

A further object is to provide a container that provides good results in a wide range of microwave oven types and styles, and that is tolerant of load or fill variations such as those that are commonly encountered in commercial products. A still further objective is to provide a container that is comparatively insensitive to variations in position in the microwave oven.

These and other objectives and advantages are achieved with a container that includes a tray with an open end, a closed base and side walls extending from the closed base to the open end, with a lid covering the open end. The closed base of the tray is constructed of a microwave transparent material such as paper-board, or an appropriate plastic material suitable for microwave cooking or reheating (e.g. polypropylene, polyester or the like), and an annular ring of conductive and microwave opaque material. The side walls include a band of conductive and microwave opaque material, such as foil, which extends from the side walls onto the closed base, forming a lip around the closed base.

The lid comprises a microwave transparent material, preferably a heat sealable grade of polyester film, and at least one conductive, microwave opaque element, separated from the side walls by an annular area of microwave transparent material. Preferably, there are one or more additional conductive, microwave opaque elements between the first element and the side walls, separated from the first element and the side walls by microwave transparent material.

These active elements of conductive, microwave opaque material, in conjunction with the boundary conditions established by the container walls and the food, act to modify the microwave fields which are incident upon the food in the container. The conductive, microwave opaque material in the side walls prevents overheating of the edges of the food. This conductive side wall material also sets well defined boundary conditions for incoming microwave energy.

The conductive elements in the side wall, base and lid are designed to work synergistically. The active elements in the lid primarily act to modify the microwave fields that are incident on the upper surface of the food. Similarly, the elements in the tray dominate the heating behavior of the lower part of the food. However, synergistic effects between the upper and lower active elements operate to enhance the overall uniformity of heating. This makes the containers of this invention suitable for products that could not be heated satisfactorily with prior art containers.

These and other advantages and objectives of this invention will be more readily apparent from the following description.

DRAWINGS

DETAILED DESCRIPTION

Figure 1:
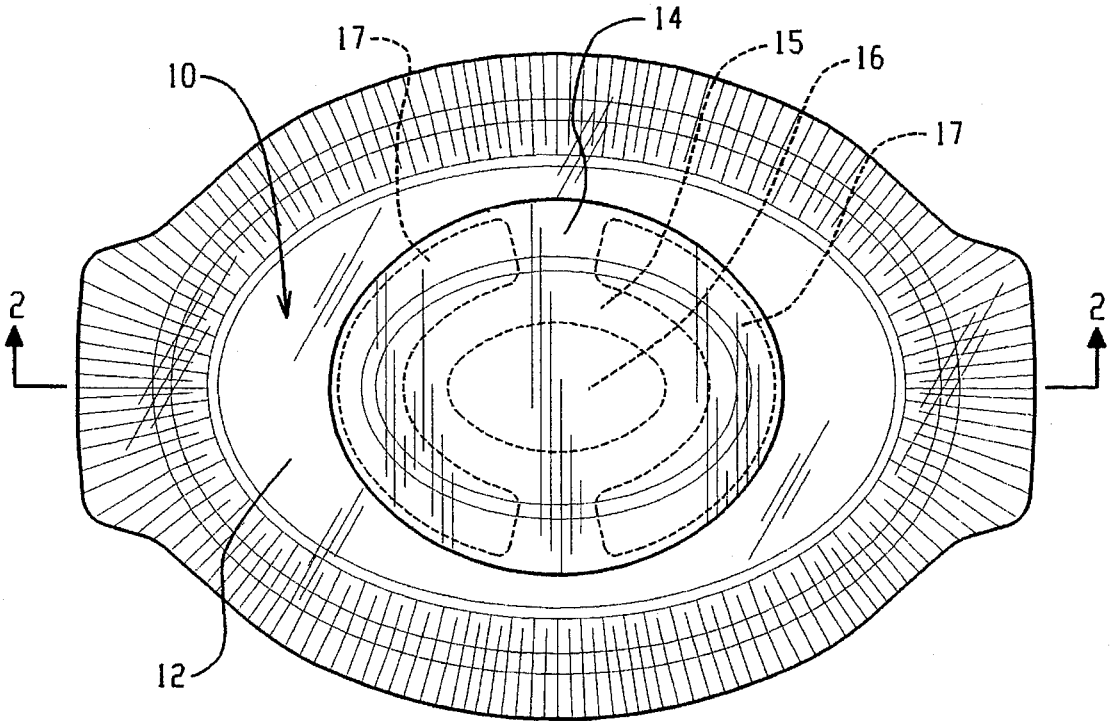
FIG. 1 is a plan view of a container embodying this invention.
Figure 3:
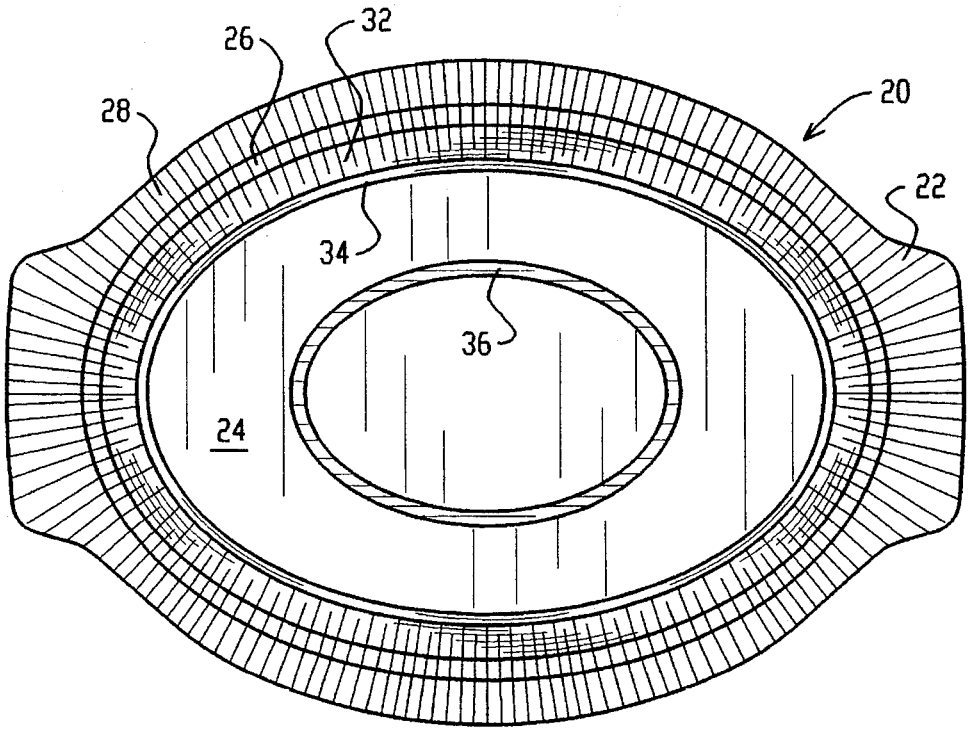
FIG. 3 is a plan view of the tray shown in FIGS. 1 and 2.
Figure 2:
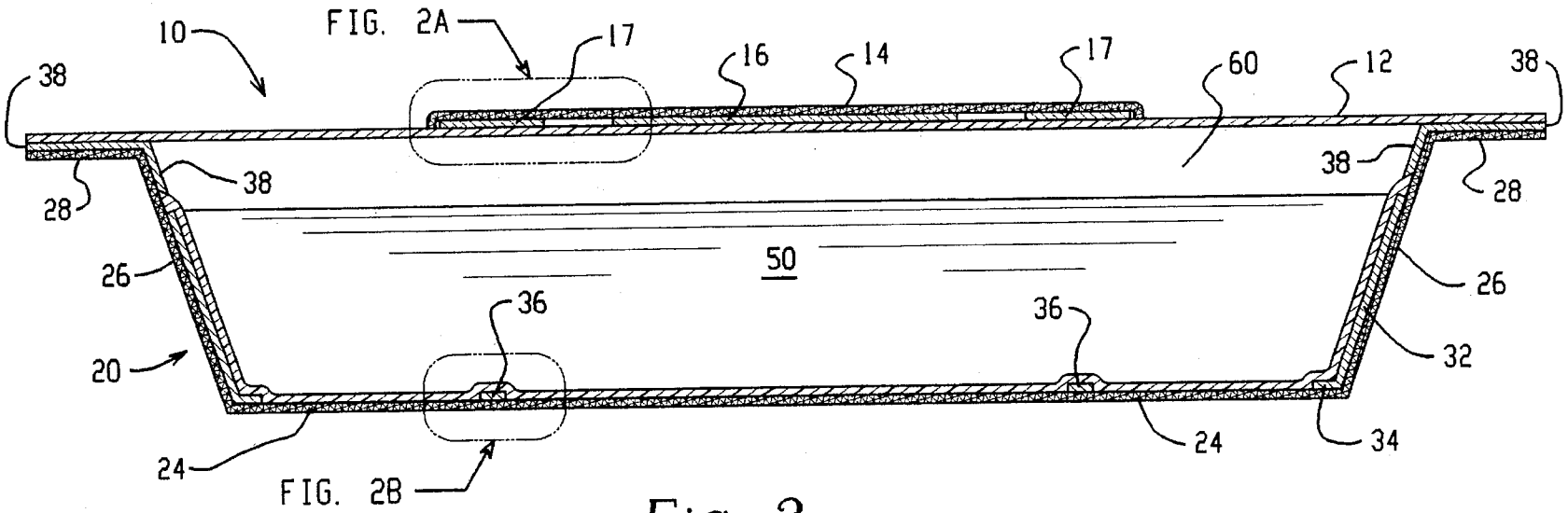
FIG. 2 is a-cross-sectional elevation view along lines 2–2 in FIG. 1.
Figure 2B:
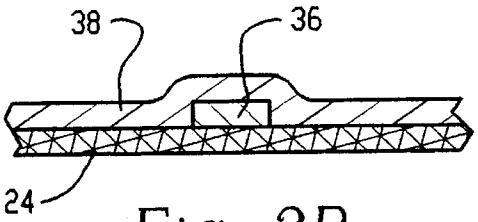
FIG. 2B is a cross-sectional detail view of the base of the container shown in FIG. 2.
Figure 2A:
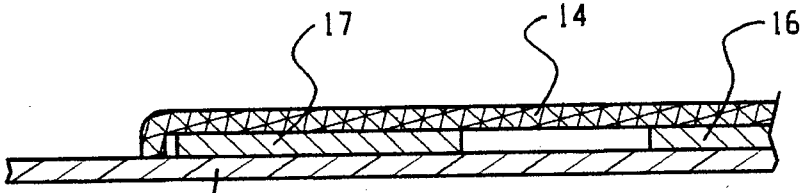
FIG. 2A is a cross-sectional detail view of the lid.

The package illustrated in FIGS. 1–3 includes an oval tray, generally referred to as 20, covered by a lid, generally referred to as 10. As seen in FIG. 2, the package holds a food product 50 which, in a preferred application, may be a relatively large portion (about 400 g) of frozen, uncooked turkey meat and gravy. There is a head space 60 between the top of the food product 50 and lid 10. The height of the head space (distance between the food product 50 and lid 10) should preferably be about 2 to 20 mm.

The tray includes a closed oval base 24 and side walls 26 which taper upward and outward from the closed base 24 to an open oval top, defined by a flange 28 which extends outwardly from the top of the side walls 26. In the preferred embodiment, the open oval top is about 185mm long by about 125 mm wide, and the inside dimensions of the closed oval base are about 165 mm long by about 105 mm wide. The side walls are about 42 mm high, measured along the sidewalls.

Tray 20 is formed, as is explained in more detail below, from a blank of paperboard or other microwave transparent material, such as plastic with foil labels or foil with apertures. Active elements are applied to the paperboard shell of the tray, and additional active elements are mounted on the lid 10. These active elements are conductive and microwave opaque. By "conductive and microwave opaque", we mean that the elements are constructed of materials that have a combination of thickness and conductivity (at microwave frequencies) so that almost all the microwave energy incident upon these elements will be reflected. The amount of the incident microwave energy that is absorbed or transmitted by these elements will, for practical purposes, be negligible. Reflection (R), absorption (A) and transmission (T) coefficients for the elements should meet the following requirements:

$R>0.9$ (i.e., more than 90% of the incident energy should be reflected);

$A+T<0.1$ (i.e., less than 10% of the energy should be absorbed or transmitted).

In the illustrated embodiment of the invention, aluminum foil at least 5 microns thick is the preferred material for the active microwave elements. Active microwave elements may also be produced, as is known in the art, by the deposition of a metallized pattern, or with conductive inks.

A band 32 of foil is attached to or embedded in the side wall 26 portion of the paperboard shell 22. A foil lip 34 (applied as an integral part of the foil band 32 in the side wall 24) extends from the side wall 26 onto the closed base 24 of tray 20. The oil band 32 prevents overheating of the edges of food within the container, and the band and lip combine to establish well defined boundary conditions for incoming microwave energy.

Preferably, the foil band extends up the sidewalls for a height of about 26 to 31 mm, which is approximately the expected height of the food in the container. If the top of the foil is more than about 5 millimeters below the top of the food, the edge of the food above the foil may be overheated. If the foil extends more than a few millimeters above the top of the food, strong localized fields that can overheat or even char the container may be generated. These fields are absorbed by the food if the food is at least as high as the foil.

Alternately, the foil band 32 can be continued to the top of the sidewalls and onto the flange 28, preferably to the edge of the flange. If the foil extends to the edge of the flange, and remains far enough away from any metal walls or other metal parts of the oven to avoid arcing, preferably at least 10 mm, energy generated at the edge of the foil band can be dissipated into the atmosphere. However, since this does create some increased risk of arcing under unusual circumstances, the preferred arrangement where the height of the food is controllable or reasonably predictable is to extend the foil band 32 to the anticipated food level.

For similar reasons, it is important to extend the foil in the sidewall 26 onto the closed base 24 of tray 20. If the foil does not extend onto the closed base 24, strong fields can develop (as if the closed end were an open end) and overheating or even charring of the container may result. The localized fields at the edge of the foil are significantly reduced when the foil extends onto the base, and is bent at an angle of about 90°to 135° to the bulk of the foil in the sidewall. The greatest reduction is obtained with an angle of 90°, but it is desirable in many instances to taper the sidewalls to facilitate removal of the trays from the molds on which they are shaped, and for efficient stacking in transportation, storage and the like. In tray 20 the band 32 and lip 34 form an angle of about 100°. This reduces the fields at the inner edge of the foil lip 34 to a level where they are easily absorbed by the food with no significant overheating.

The preferred width of foil lip 34 is between about 2 mm and about 10 mm. If foil lip 34 is wider than 10 mm, there may be excessive shielding, and less than optimal heating of the food in lower corners of the tray. If the lip is narrower than 2 mm, manufacturing irregularities may yield spots where the foil band 32 stops short of the bottom of the side wall 26, with no foil lip. As noted above, this may produce undesirable field intensification at the side wall.

The closed base 24 of tray 20 also includes an annular ring 36 of conductive, microwave opaque aluminum foil. The annular ring 36 should be similar in shape to the base. That is to say, the ratio of the minor axis (or width) to the major axis (or length) of the ring should be the same as, or similar to, the ratio of the minor axis to the major axis of base 24. For example, for the illustrated oval container, the ratio of width to length of annular foil ring 36 is approximately equal to 0.65, and the width to length ratio for the container base 24 is approximately 0.62. The dimensions of the ring (the average of the inner and outer dimensions) should also have an approximately constant ratio, moving angularly around the ring, with equivalent dimensions of the container base aperture (i.e. the aperture delineated by the inner edge of lip 34). In the case of a circular or elliptical container, this ratio should preferably be within the range between about 0.4 and 0.7 and ideally between about 0.5 and 0.6. In the illustrated container, this ratio is about 0.55. The ring has an maximum overall diameter (the distance from outer edge to outer edge of the ring along its major axis) of about 90 mm, which is about 0.55 times the 165 mm overall length of the base, and an minimum overall diameter (measured in the same manner) of about 60 mm, about 0.55 times the 105 mm width of the base. This ratio may vary from point to point around the container, due to manufacturing distortions and the like, and variations of up to 0.15 in this ratio will be satisfactory in many applications, but a relatively constant ratio is preferred.

The preferred width of annular ring 36 (the distance from outer edge to inner edge at any point around the ring) is also between about 2 mm and about 10 mm, of sufficient size to interact with the microwave energy but narrow enough so as not to result in a shielded region of any significance above the ring 36. Annular rings narrower than about 2 mm could function satisfactorily providing that the electrical conductivity of the ring remains sufficiently high to cause the desired field modification, but with increased difficulties and costs of manufacture for reliable and consistent production. Similarly, if lip 34 is narrower than about 2 mm, the alignment of material during container pressing becomes very critical and expensive to control.

Figure 6:
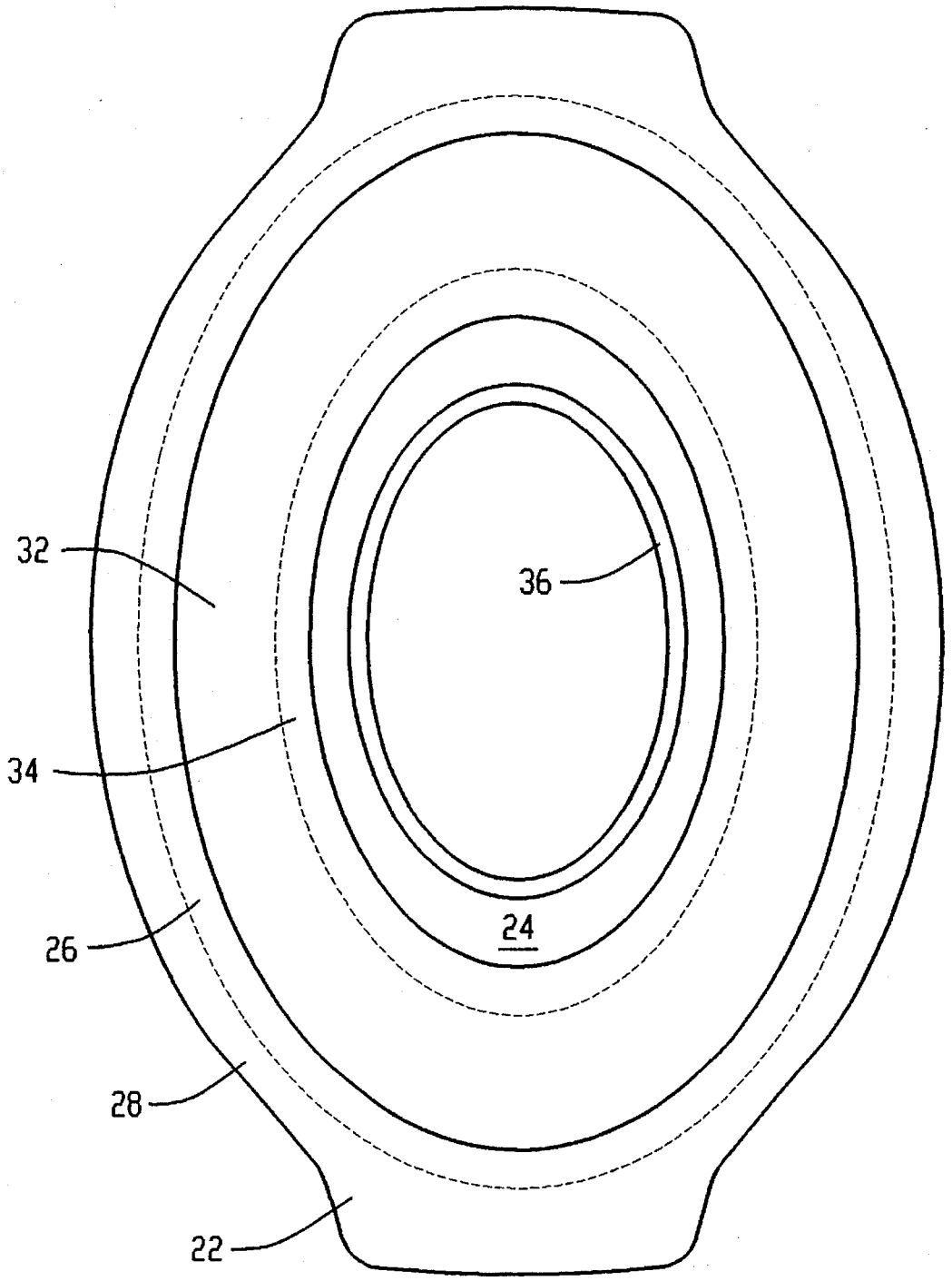
FIG. 6 is a plan view of a composite sheet used to make the tray of the container shown in FIGS. 1–3.

The construction of the container tray illustrated herein may be seen with reference to FIGS. 3 and 6. The tray is constructed from a blank or shell 22 of 282# milk carton stock paperboard. The side wall band 32, lip 34 and annular ring 36 are applied to shell 22 by adhesively laminating 8 micron foil to a film 38 of 48 gauge PET, or polyethyleneterephthalate, demoralizing the foil to form the desired patterns for sidewall band 32, lip 34 and annular base ring 36, and adhesively bonding the foil/PET laminate to the paperboard. Pleats 46 (shown in FIG. 3) are then formed in the side walls 26 and flange 28, using conventional technology, to produce the tray shown in FIGS. 2 and 3.

Additional microwave active elements are provided in the container lid 10. The lid includes a sheet of microwave transparent film 12, an oval active element of aluminum foil 16, preferably positioned at or near the center of the container, and two ring segments 17, also of aluminum foil. The ring segments 17 are separated from the central oval 16, from the side walls, and from each other by microwave transparent material. Thus, the ring segments define an interrupted annular lid ring, interrupted by the spaces of microwave transparent material between the ends of the ring segments.

Central oval 16 and annular ring segments 17 are formed by die cutting adhesive coated pressure-sensitive foil. Oval 16 and ring segments 17 are then positioned on one large piece of adhesive coated pressure sensitive paper stock, or label 14, which acts as a carrier and keeps the active elements in proper relationship to each other. Label 14 is adhesively bonded to the transparent film 12. After the food product 50 has been placed in the container, film 12 is heat sealed to flange 28 with a bond strength of at least 100 grams to close the open end of tray 20.

The central oval 16 should be similar in shape to the top-inner shape of the container and the ratio of the principal dimensions of the oval to the corresponding dimensions of the top-inner container dimensions should be approximately constant. That is to say, the ratio of the length of oval 16 to the container top-inner length should be the approximately the same as the ratio of the width of the oval to the container top-inner width. For an oval lid with three active elements, such as the illustrated container, the preferred ratio is between 0.2 and 0.3. In this container, the length of oval element 16 is approximately 0.27 times the length of the container, and the width of oval 16 is approximately 0.23 times the top-inner width of the container. As with the annular ring 36 in the base 24 of the tray, it is preferable to have a substantially constant ratio between the diameter of the oval and the diameter of the open end of the container at any angular position around the container.

The size of the central oval can vary somewhat without significantly changing the effectiveness of enhancing or modifying the microwave energy in the central portion of the container. As the oval decreases in size, however, it becomes less tolerant of headspace variance and the concentration of the microwave field intensity could result in very intense heating of a small central region of the food surface rather than a larger, more diffuse region heated to a greater depth into the food. Increasing the size of the central oval element generally leads to a decrease in intensity of the modified field which also affects the overall performance.

A lid with one central foil element is fairly effective in improving the overall heating performance of the container. As the size of the tray increases, however, additional elements, such as the annular ring segments 17 are required to distribute the microwave energy more uniformly.

Annular ring segments 17, and the gaps between them, are segments of an interrupted annular ring with dimensions which are determined in relation to the central oval 16 in the following way:

1. The distance from the inner edge of the interrupted annular ring to the edge of the central oval 16 should be approximately constant. For the illustrated container, this distance should be about 10 to 25 mm, and is preferably about 10 mm.
2. The width of the annular ring defined by ring segments 17 should also be approximately constant. For the illustrated container, this ring should be about 10 to 20 mm wide (preferably 15 mm).
3. The corners of the annular ring segments should be rounded (a radius of about 2 mm or greater) to avoid sharp corners that could cause local field intensification.
4. The gaps between the two annular ring segments are approximately 15 mm (inside edge) and 20 mm (outer edge).

The size, shape and spacing of the annular ring segments 17 were established empirically; small adjustments to size and position being made to "fine tune" the container performance and to achieve the desired degree of uniformity while, at the same time, avoiding any possibilities of arcing or dielectric breakdown between the annular ring segments, or between one of the ring segments and the central oval 16.

These dimensions, which have been determined experimentally, are quite critical. Deviations greater than about 2 mm tend to give rise to excessive fields around the edges of the active elements. The effectiveness would also diminish if the gaps were significantly larger.

Figure 4:
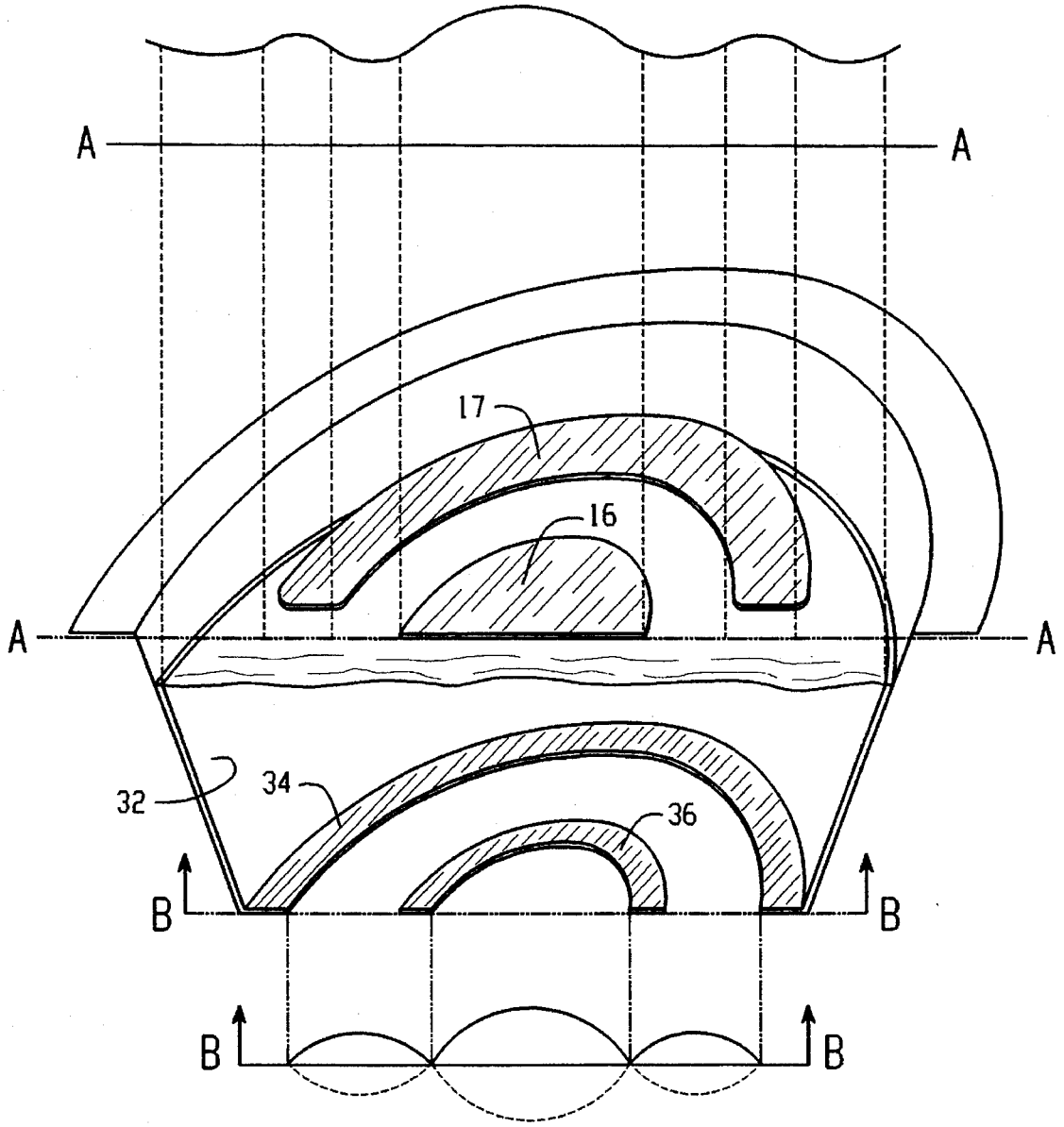
FIG. 4 is a cutaway perspective view of the container in FIGS. 1–3, along the lateral axis of this container, with curves of the variation in the electric field intensity at the top of the food within the container (AA) and at the base of the container (BB).

As may be seen in FIG. 4, which is a cut-away drawing of the illustrated oval container showing one half of the container and the disposition or the various active elements as described above, central oval 16, ring segments 17, sidewall foil band 32, foil lip 34 and annular base ring 36 cause a substantial redistribution of microwave energy incident upon the lid and base of container. Plot A—A illustrates the modified field intensity distribution which results from the action of these active elements at the top of the food load, determined by temperatures obtained in tests of the illustrated container. Plot B—B illustrates the field intensity distribution of energy which enters the food through the base of the container. While the actual field intensities will depend on the particular oven, the size of the food load and so forth, temperature measurements from tests with the illustrated container confirm that under typical conditions, the average energy entering through the bottom of the container or, in other words, the time averaged field intensities, will be within about ±20% of the average energy entering through the top of the container. It will also be noted that the energy distribution is much more uniform than that which normally arises when food in an unmodified container is subjected to microwave energy.

The effects of the active elements of this container in producing this uniform distribution may be understood more readily in the context of a discussion of the performance of the container without these active elements. Microwave heating of food arises because of the interaction between the rapidly changing electric field and molecules or ions within the food. Water molecules and salts play an important role, especially in the unfrozen state. In the frozen state, water and salts cannot respond to the incident field (by rotation or vibrating) as readily so that microwaves do not heat as effectively.

Power absorption (per unit volume) is proportional to the square of the electric field.

$P=2\pi f\epsilon_o\epsilon_r E^2$ where P is the power absorbed ($W/m^3$) f is the microwave frequency (2.45 $GH_z$ for domestic microwave ovens)

$\epsilon_o$ is the electric permittivity of free space $\epsilon_r$ is the relative permittivity (e.g. of the food)

E is the electric field (magnitude) at the location of interest (V/m).

In a container with the same shape and dimensions as the illustrated container, but without the central oval 16 and annular ring segments 17 in the lid, the foil band 32 in the sidewalls and the foil lip 34 and annular ring 36 in the base, the predominant field intensity pattern will be determined by the size and shape of the food load and the field distributions within the oven. For most foods, the dielectric properties at microwave frequencies are substantially different from the free space (or air) values. This means, for example, that the wavelength in the food (unfrozen) will typically be about 12 mm, whereas in air the corresponding wavelength is about 120 mm. For microwaves which encounter the food, these large changes in dielectric properties at the food-air interfaces cause reflections and refraction effects to occur which in turn modify the overall field distributions in the food and within the oven cavity. The net result is that the field distributions arriving at the food surfaces have to conform to the "boundary conditions" imposed by the presence of food in the container.

In general, several field patterns or modes will be consistent with the boundary conditions. However, for typical food containers, the most commonly occurring field distributions (modes) have intense fields around the edges with intensity minima in the central region. (This is why the central region of many food products tends to be very difficult to heat effectively, while the edges heat efficiently).

In rectangular containers, these field distributions can be described in terms of combinations of sine and cosine functions (by analogy with rectangular waveguides or cavities). For round or elliptical containers, the corresponding mathematical descriptions are based on Bessel functions or modifications of Bessel functions.

Active elements such as foil or other conductive, microwave opaque materials are designed to modify this field distribution so as to produce a more desirable and uniform pattern of heating. Microwave energy arriving at a conducting element will cause electric currents to be induced in the conductor. The exact pattern and intensity of these currents will depend on the detailed relationship between the arriving microwave energy and the shape and dimensions of the foil. (For example it is well known that a foil strip of approximately 6 cm in length will develop strongly resonant currents (at 2.45 GHz) because it acts as a half wavelength antenna).

Foil or other conductive elements on a microwave transparent lid can modify the fields by developing higher order modes in close proximity to the food surface. The size, shape and quantity of the elements, and the distance between the lid and the food, influence the effect of the modified field. Oval containers are best modified by elements which simulate the container shape. Likewise circular and square or rectangular containers would best be modified by elements and patterns of similar shapes.

In the case of an oval foil element (as used for the central oval 16 in this container), the patterns of electric currents which are induced will be characteristic of the shape and size of the element. These rapidly changing, circulating currents will, in turn, lead to the re-radiation of microwave energy. In effect the element is acting as a "patch antenna". Since the element is close to the food surface, a substantial fraction of the energy will propagate and arrive at the food surface.

The central oval 16 enhances the microwave intensity in the central region relative to the outer regions. This improves heating uniformity significantly. However, for an oval container, the dominant mode (or field pattern) generated by the combined influence of the single label and container results in a heating distribution which, although relatively uniform, has some residual cooler regions (diffuse regions in the annular region between the zone covered by the central label and the outer container wall, mainly towards the ends of the container).

To further improve the heating uniformity, the two annular ring segments 17 were incorporated into the structure. As may be seen from curve A—A of FIG. 4, the ring segments modify the field distribution generated by central oval 16, and provide a localized enhancement of the field (heating) in the region immediately below the annular ring segments 17.

As may be seen from Plot B—B of FIG. 4, the active elements in the base of the tray modify the energy distribution at the bottom of the container. This plot is a schematic representation of the field intensity across a line through the bottom of the container, the active elements in the tray modify the energy distribution at the bottom of the container, producing a central field maximum and two subsidiary maxima (one on each side) corresponding to the aperture defined by the annular ring 36 and the foil lip 34. Minimum field intensity positions are located at the annular ring 36 and inner edge of the foil lip 34. The conductive foil components cause the components of the electric field parallel and adjacent to the conductors to be zero because any non-zero electric field causes charge to flow within the conductor until and equal and opposite filed is generated to exactly cancel the original field. The foil edges, therefore, constitute boundary conditions for microwaves arriving at the base of the container such that some key field components will be zero at the annular base ring 34 and the inner edges of foil lip 34.

As will be seen from FIG. 4, and from the following Example, the active elements in the lid 10 and tray 20 work synergistically to effectively distribute energy so that even defrosting, heating and cooking can occur. With this distribution, relatively deep food loads (25–40 mm) and foods that are not homogeneous, such as meat and gravy, and entrees and side dishes, can be packaged for microwave defrosting, heating and/or cooking. This makes microwave heating practical for many products that could not be defrosted, heated or cooked satisfactorily with prior art packaging, which has typically been designed for shallower food loads and/or foods that are more homogeneous in nature, such as macaroni and cheese, pasta, sliced meats and the like.

EXAMPLE 1

Tests were conducted with an oval container having a length which tapered from 185 mm at the open end of the tray to 165 mm at the base of the tray, and a width which tapered from 125 mm to 105 mm. The side walls of the tray were 42 mm high (measured along the side wall at one end of the container) and contained an aluminum foil ring 31 mm high. The base of the container included an annular ring of aluminum foil, 8 microns thick, with a maximum and minimum overall diameter of 90 mm×60 mm. The lid included a central oval 50 mm long by 30 m wide and two ring segments, each 15 mm wide, spaced 10 mm from the central oval with gaps of 15 mm between the ends of the ring segments.

Figure 5:
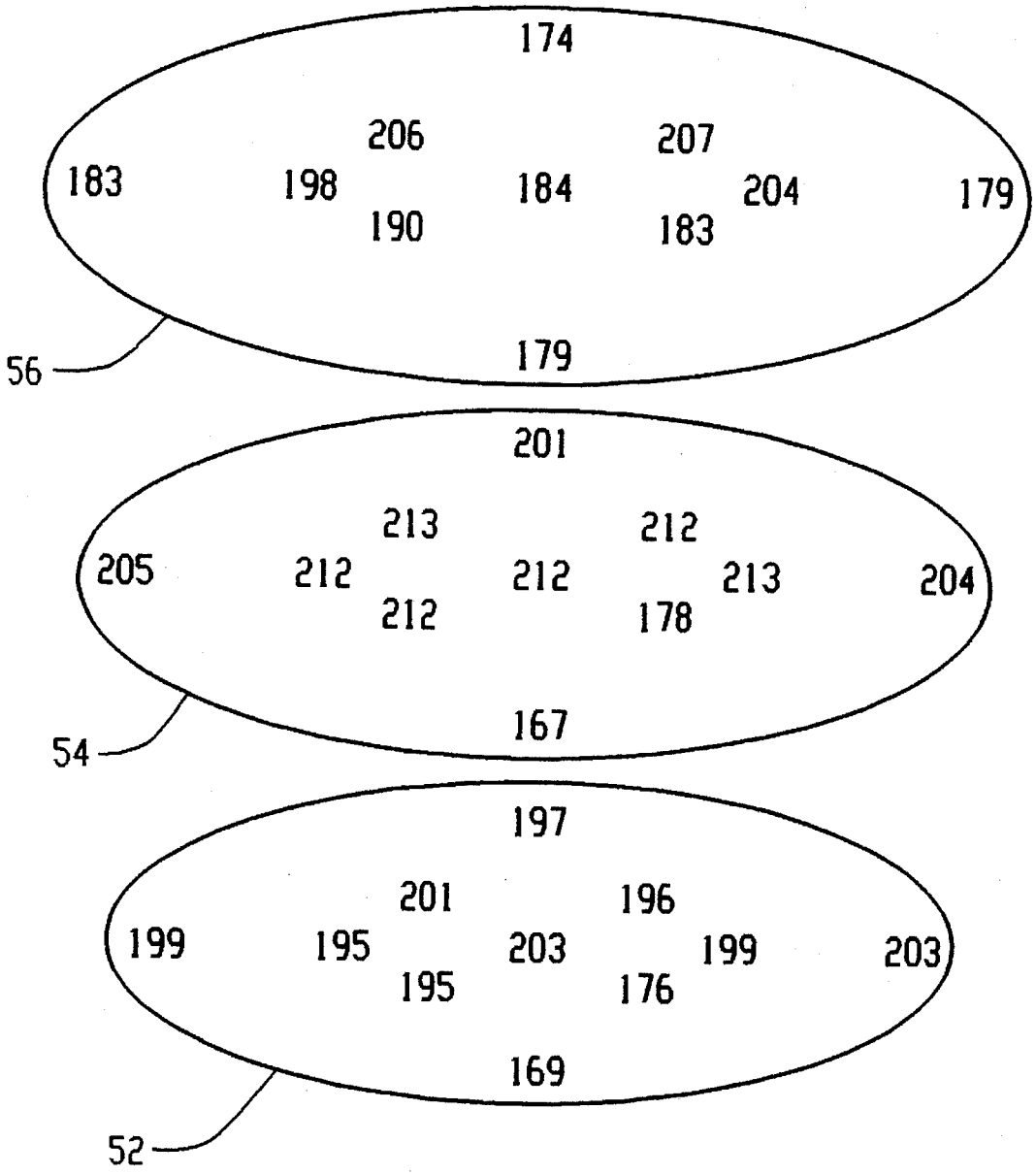
FIG. 5 illustrates the distribution of temperatures achieved in a container embodying this invention.

The tests were conducted in a Kenmore 750 watt oven with the container centered in the oven. The container was heated at the high power setting for 12 minutes. At the end of the heating cycle, temperatures were recorded as quickly as possible, and within less than 90 seconds of the end of the 12 minute heating time, using 12 calibrated thermocouples at three levels in the product. The figures in the oval 52 of FIG. 5 represent bottom temperatures, recorded approximately 2 to 3 millimeters above the base of the container. The figures in oval 54 were recorded at a depth corresponding to about 15 millimeters above the base at the container (at the estimated mid-depth of the food). The top temperature measurements, in oval 56, were from the zone just below the surface (about 2 millimeters below the top food surface).

The product, approximately 8 ounces of turkey breast meat and about 8 ounces of gravy, had a total weight of 16 ounces. Weight loss was determined by weighing the product before and after cooking. The weight loss was 11.8%, well within the range of up to 15% wherein uniformly heated products of this type are generally found to have retained good appearance and eating qualities.

Thus, it may be seen that this invention provides a number of significant advantages over prior art microwave heating containers. Heating is more uniform, and energy is utilized more efficiently. Those skilled in the art will readily appreciate that various modifications may be made in the container described above within the scope of this invention. For example, the dimensions given here are the preferred dimensions for the illustrated oval container, when used for an uncooked, frozen meat product with gravy. For other products, final adjustments may need to take into consideration the nature of the food and the food heating requirements. If the products that are not homogeneous, or where the fill depth varies in different parts of the container, as with meat, vegetables or other side dishes, it may be desirable to increase the heating of one part relative to another. In general, small adjustments in the size and spacing of the active elements can produce sufficient modifications to the heating behavior. For example, small reductions in the dimensions of the central oval 16 and annular ring segments 17 on the lid will tend to concentrate more energy into the central region. Slight increases in the dimensions of the central oval 16 and annular ring segments 17 tend to produce more diffuse, lower intensity heating in the central part of the container.

For containers of different shapes and dimensions, adjustments to these dimensions may be necessary. These and other modifications may be made within the scope of this invention, which is defined by the following claims.

We claim:

1. In a container comprising a tray having an open end, a closed base and side walls extending from said closed base to said open end, and a lid covering said open end, the improvement wherein:

said side walls comprise a microwave transparent material which extends from said closed base to said open end, and conductive, microwave opaque material which extends from said side walls onto said closed base and forms a lip at the edge of said closed base;

said closed base comprises an annular base ring of conductive, microwave opaque material encompassing a first area of microwave transparent material, and a second area of microwave transparent material between said annular base ring and said lip, said annular base ring and said lip being designed and adapted to establish boundary conditions at said base ring and at said lip that produce a central energy maxima within said first area and a subsidiary energy maxima in said second area;

said lid comprises a microwave transparent material and a first conductive, microwave opaque element, said element being separated from said side walls by an annular area of said microwave transparent material and designed and adapted to enhance microwave intensity under said element;

whereby said side walls, said base and said lid co-operate to produce more uniform heating within said container.

2. A container according to claim 1 wherein said lid further comprises at least one additional conductive, microwave opaque element positioned between said first element and said side walls and separated from said first element, and from said side walls, by microwave transparent material.

3. A container according to claim 2 having at least two additional conductive, microwave opaque elements positioned between said first conductive, microwave opaque element and said sidewalls, each of said additional elements comprising a section of an interrupted annular lid ring, said ring being interrupted by microwave transparent material between ends of said additional conductive, microwave opaque elements.

4. A container according to claim 3 wherein said first element and said interrupted annular lid ring are oval, said interrupted annular lid ring is about 10 to 20 mm wide and the distance between said first element and said ring is about 10 to 25 mm.

5. A container according to claim 4 wherein said interrupted annular lid ring is about 15 mm wide and the distance between said first element and said ring is about 10 mm.

6. A container according to claim 3 wherein the first element and the open end of the tray are oval, the ratio of the length of the first element to the length of the open end of the tray, and the ratio of the width of the first element to the width of the open end of the tray, are between about 0.2 and 0.3.

7. A container according to claim 6 wherein the ratio of the length of the element to the length of the open end of the tray is about 0.27, and the ratio of the width of the element to the width of the open end of the tray is about 0.23.

8. A container according to claim 6 wherein the ratio between the diameter of the first element and the diameter of the open end is substantially constant at any angular position around the tray.

9. A container according to claim 1 wherein said closed base and said open end are oval.

10. A container according to claim 9 wherein said open end of said tray is larger than said closed base, and said side walls taper outwardly from said base to said open end.

11. A container according to claim 9 wherein said open end is about 185 mm long by about 125 mm wide, said closed base is about 165 mm long by about 105 mm wide, and the height of said side walls is about 42 mm.

12. A container according to claim 11 wherein the ratio of the diameter of the said annular base ring to the diameter of said base at any angular position around said container is between about 0.4 and about 0.7.

13. A container according to claim 12 wherein the said ratio does not vary by more than about 0.15.

14. A container according to claim 11 wherein the ratio of the diameter of the said annular base ring to the diameter of said base at any annular position around said container is between about 0.5 and about 0.6.

15. A container according to claim 11 wherein the ratio of the diameter of the said annular base ring to the diameter of said base at any annular position around said container is about 0.55.

16. A container according to claim 1 wherein the conductive material in said side walls extends for the entire circumference of said side walls.

17. A container according to claim 16 wherein the conductive material in the side walls extends from said closed base up said side walls for a distance of about 26 to 31 millimeters.

18. A container according to claim 1 wherein said conductive material in said side walls extends onto said closed base for a distance of about 2 mm to 10 mm.

19. A container according to claim 1 further comprising a flange extending outwardly from said side walls at said open end.

20. A container according to claim 19 wherein said conductive material in said side wall extends from said closed base to said open end and extends outwardly along said flange for the entire width of said flange.

21. A package adapted for microwave defrosting and cooking or heating of frozen foods comprising:

an oval tray having an open end, a closed base that is smaller than said open end, and side walls tapering outwardly from said closed base to said open end, said side walls comprising a microwave transparent material which extends from said closed base to said open end, and conductive, microwave opaque material which extends from said side walls onto said closed base and forms a lip at the edge of said closed base;

said closed base comprising an annular base ring of conductive, microwave opaque material encompassing a first area of microwave transparent material, and a second area of microwave transparent material between said annular base ring and said lip, said annular ring and said lip being designed and adapted to establish boundary conditions at said ring and at said lip that produce a central energy maxima within said first area and a subsidiary energy maxima in said second area:

an oval lid that covers the open end of said tray, said lid comprising microwave transparent material, a central patch of conductive, microwave opaque material; and at least two additional patches of conductive, microwave opaque material positioned between said central patch and said sidewalls, each of said additional patches comprising a section of an interrupted annular lid ring that is separated from said central patch by an annular ring of microwave transparent material, said annular lid ring being interrupted by microwave transparent material between ends of said patches of conductive material and said annular lid ring being separated from said side walls by an annular area of microwave transparent material, said central patch being designed and adapted to enhance microwave intensity under said lid in the central region of the container, and said interrupted annular ring being designed to provide localized enhancement of heating in the area beneath said annular lid ring;

whereby said side walls, said base and said lid co-operate to produce more uniform heating within said container.

22. A package adapted for heating in a microwave oven comprising:

a tray having an open end, a closed base and side walls extending from said closed base to said open end;

said side walls comprising a microwave transparent material which extends from said closed base to said open end, and conductive, microwave opaque material which extends from said side walls onto said closed base and forms a lip at the edge of said closed base;

said closed base comprising an annular base ring of conductive, microwave opaque material encompassing a first area of microwave transparent material, and a second area of microwave transparent material between said annular base ring and said lip, said annular base ring and said lip being designed and adapted to establish boundary conditions at said base ring and at said lip that produce a central energy maxima within said first area and a subsidiary energy maxima in said second area;

a body of material to be heated positioned within said tray;

a lid covering said open end of said tray and said body of material to be heated, said lid comprising microwave transparent material and a first, conductive, microwave opaque element, said element being separated from said side walls by a an annular area of said microwave transparent material and designed and adapted to enhance microwave intensity under said element;

whereby said side walls, said base and said lid co-operate to produce more uniform heating within said container.

23. A package according to claim 22 wherein said body of material to be heated comprises a foodstuff.

24. A package according to claim 22 wherein said foodstuff is frozen and uncooked.

25. A package according to claim 22 wherein said band of conductive material in said side walls extends from said closed base up said side walls to a level below the top of the material to be heated and the portion of said side walls between said level and said open end is microwave transparent.

* * * * *